US005830118A

United States Patent [19]

Nicholson

[11] Patent Number: 5,830,118

[45] **Date of Patent: *Nov. 3, 1998**

[54] PACKAGING MACHINE FOR FORMING FREE-STANDING POUCHES

[75] Inventor: John G. Nicholson, Sarasota, Fla.

[73] Assignee: Klockner Bartelt, Inc., Sarasota, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 529,150

[22] Filed: Sep. 15, 1995

[51] Int. Cl.[6] ..... B31B 49/04

[52] U.S. Cl. ..... 493/196; 493/201; 493/209; 493/227

[58] Field of Search ..... 433/186, 189, 433/193–203, 206, 209, 227, 229, 230, 232, 233; 53/562, 370.7; 83/684–688, 690, 691, 164, 98, 34; 72/326, 333, 403, 404, 405.01, 405.02, 405.06

[56] References Cited

U.S. PATENT DOCUMENTS

| | | | |
|---|---|---|---|
| 356,113 | 1/1887 | Forbes | 83/685 |
| 415,477 | 11/1889 | Stevens | 83/685 |
| 1,430,546 | 10/1922 | Hadaway | 83/684 |
| 2,168,377 | 8/1939 | Waves | 83/164 |
| 2,579,940 | 12/1951 | Lobrovich | 83/98 |
| 2,622,682 | 12/1952 | Kopczynski | 83/686 |
| 2,732,898 | 1/1956 | Taylor | 83/164 |
| 2,807,323 | 9/1957 | Taylor | 83/164 |
| 2,893,488 | 7/1959 | Schott | 83/164 |
| 3,124,027 | 3/1964 | Loeffel | 83/98 |
| 3,176,569 | 4/1965 | Daniels | 83/686 |
| 3,211,038 | 10/1965 | Lake et al. | 83/468.9 |
| 3,211,039 | 10/1965 | Sheetz | 83/685 |
| 3,213,730 | 10/1965 | Byam | 83/34 |
| 3,253,493 | 5/1966 | Weisbeck | 83/685 |
| 3,367,164 | 2/1968 | Franks et al. | 72/324 |
| 3,553,934 | 1/1971 | Johnson et al. | 83/34 |
| 3,580,120 | 5/1971 | Adams et al. | 83/98 |
| 3,595,139 | 7/1971 | Adams et al. | 493/235 |
| 3,646,797 | 3/1972 | Overway | 72/326 |
| 3,878,705 | 4/1975 | Iffland | 72/333 |
| 3,983,794 | 10/1976 | Buckner | 493/189 |
| 4,040,320 | 8/1977 | Cloup | 83/685 |
| 4,046,065 | 9/1977 | Plate | 493/209 |
| 4,048,890 | 9/1977 | Aeschbach | 83/685 |
| 4,055,109 | 10/1977 | Kan | 493/196 |
| 4,257,292 | 3/1981 | Faull | 83/685 |
| 4,273,015 | 6/1981 | Johnson | 83/670 |
| 4,406,646 | 9/1983 | Jentsch | 493/209 |
| 4,653,372 | 3/1987 | Potiorff | 83/684 |
| 4,708,042 | 11/1987 | Jung | 83/685 |
| 4,843,931 | 7/1989 | Whistler | 83/685 |
| 4,947,717 | 8/1990 | Whistler | 83/98 |
| 4,954,124 | 9/1990 | Erickson et al. | 493/189 |
| 5,006,186 | 4/1991 | Yokoyama | 493/189 |
| 5,015,223 | 5/1991 | Boeckman | 493/199 |
| 5,048,385 | 9/1991 | Eckert et al. | 83/34 |
| 5,080,747 | 1/1992 | Veix | 493/189 |
| 5,111,723 | 5/1992 | Andrusch et al. | 83/98 |
| 5,149,315 | 9/1992 | Muhs | 493/189 |
| 5,181,365 | 1/1993 | Garvey et al. | 493/196 |
| 5,214,991 | 6/1993 | Shimizu et al. | 83/687 |
| 5,273,514 | 12/1993 | Kristensen | 493/195 |
| 5,468,206 | 11/1995 | Buchanan | 493/189 |
| 5,514,067 | 5/1996 | Schmidt et al. | 493/233 |

*Primary Examiner*—Michael J. Carone
*Assistant Examiner*—Darren Ark
*Attorney, Agent, or Firm*—Leydig, Voit & Mayer, Ltd.

[57] ABSTRACT

Longitudinally spaced pairs of laterally spaced openings are formed in a web of material prior to the web being folded into a pouch having a gusset bottom, the holes enabling the side panels of each pouch to be heat-sealed directly together at the side margins of the pouch and in the area of the gussets. To enable the lateral spacing between the openings of each pair to be easily changed and to enable the openings to be located extremely close to the longitudinal centerline of the web, the openings are formed by punches supported by separate punch frames which may be independently adjusted in a direction laterally of the web. The punch frames also are adjustable relative to one another in a direction longitudinally of the web in order to enable the machine to make pouches of various widths.

5 Claims, 6 Drawing Sheets

PACKAGING MACHINE FOR FORMING FREE-STANDING POUCHES

BACKGROUND OF THE INVENTION

This invention relates generally to a machine adapted to form flexible envelope-type pouches and, more particularly, to a machine adapted to form pouches having gussets adapted to fold downwardly so as to form a relatively flat bottom which enables the pouch to be free-standing when the pouch is filled. While suitable for many purposes, pouches of this type are especially useful for packaging food and other products for shelf storage or for sale.

In a machine of this type, a flexible web having heat-sealable material on one side is advanced step-by step through the machine, each step being equal in distance to the width of the pouches. As the web advances through the machine, the web is folded into two outer panels and two interconnected inner panels or gussets which are joined to the bottom margins of the outer panels, the heat-sealable material being located on adjacent surfaces of the gussets and the outer panels. The folded web then advances to a sealing station where a pair of heated seal bars forms laterally extending seals in the folded web so as to define a row of pouches interconnected at their adjacent side edges by the newly formed seals. Thereafter, the leading pouch is severed from the advancing row of pouches by a pair of cut-off blades which cut through the center of each of the seals.

In one type of gusset pouch, the inner sides of the lower ends of the outer panels are connected together through aligned cut-outs formed in the side margins of the gussets to prevent the sides of the gussets from unfolding and to prevent the lower ends of the outer panels from expanding when the pouch is filled. To this end, pairs of laterally aligned openings spaced along the length of the web by a distance equal to the pouch width are formed in the web before the web is folded. The openings of each pair are equally spaced from the longitudinal centerline of the web so that, when the web is folded along the centerline, the openings are aligned with one another. During formation of the pouches, the travel of the web is phased so that one pair of openings is aligned with the seal bars each time the seal bars form a seal at the side of the pouch. As a result, the heat-sealable surfaces on the inner surfaces of the lower side margins of the outer panels are brought into contact and are bonded together through the aligned openings in the gussets when pressure is applied to the folded web by the seal bars. This arrangement provides additional stiffness to the lower edges of the filled pouch to aid in stabilizing the free-standing pouch.

Precision punches and dies are typically used to form the openings in the web. To enable the punches to cleanly shear or cut through the relatively thin, flexible, and somewhat elastic web, without fraying or feathering the edges of the openings, the outside diameter of each punch is closely matched with the inside diameter of the die so that the clearance between the punch and the die is on the order of only about 0.0005 inch.

A punch requires a relatively large frame for holding an actuating cylinder or other means for actuating the punch. If the lateral spacing between the openings of each of the pairs, i.e., the gusset height, is relatively small, it is not possible to use two laterally aligned punch frames for forming the laterally aligned openings. For this reason, prior machines mount two laterally spaced punch and die sets in one punch frame. As a result, the frame and the punch and die sets must be changed each time that a pouch having a different gusset height is to be formed on the machine, i.e., when the lateral spacing between the openings must be adjusted.

Changing the punch and die set is complicated by the fact that, in many prior machines of this type, the punch and die set is part of an assembly which includes peripheral equipment such as guide rollers for the advancing web. To change the punch and die set, the entire assembly must be changed. These assemblies are often relatively large and awkward to remove and replace. As a result, additional changeover time is required to change the punch and die set between runs of differently sized pouches having gussets of a different height. Moreover, the need to purchase the additional, extra peripheral equipment further increases the capital costs associated with forming pouches with differently sized gussets on the same machine.

In addition, the minimum spacing between the openings of each pair is limited in prior machines that utilize these types of punch and die sets since the two punches must be laterally spaced from one another at least by a minimum distance. The inability to locate the punches extremely close to the centerline of the web makes the machine incapable of producing pouches having gussets of extremely small height.

SUMMARY OF THE INVENTION

The general aim of the present invention is to provide a new and improved packaging machine which, when compared to prior machines of the same general type, is capable of being more easily, quickly and economically changed over to make free-standing pouches having gussets of various heights.

A further object of the invention is to provide a machine having the capability of being easily set up to make pouches having gussets of very small height.

Still another object of the invention is to eliminate the need for multiple punch and die assemblies for making pouches having various gusset heights and to eliminate the need for replacing one punch and die assembly with another when the machine is changed over to run pouches having gussets of a different height.

A more detailed object is to achieve the foregoing by providing two independently adjustable punch and die assemblies which are capable of being shifted both laterally and longitudinally to enable openings to be punched in the web at various lateral and longitudinal spacings and to enable the openings to be located on or in very close proximity to the longitudinal centerline of the web.

These and other objects and advantages of the invention will become more apparent from the following detailed description when taken in conjunction with the accompanying drawings.

Figure 2:
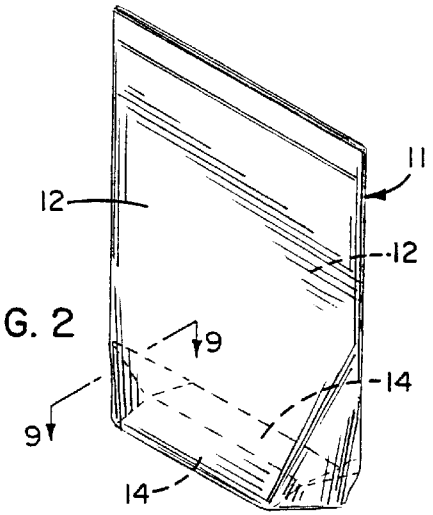
FIG. 2 is a perspective view of a pouch filled with a product.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

For purposes of illustration, the present invention is shown in the drawings in connection with a machine 10 (FIG. 1) adapted to make flexible envelope-type pouches 11 formed with open upper ends and with expandable, side-supported, gusseted bottoms. Such a machine is typically part of a packaging machine which, after making a pouch, fills the pouch with a premeasured product and then seals the upper end of the pouch. A packaging machine of this general type is disclosed in Johnson U.S. Pat. No. 3,553,934 and thus certain elements of the machine 10 need not be described in detail.

Figure 8:
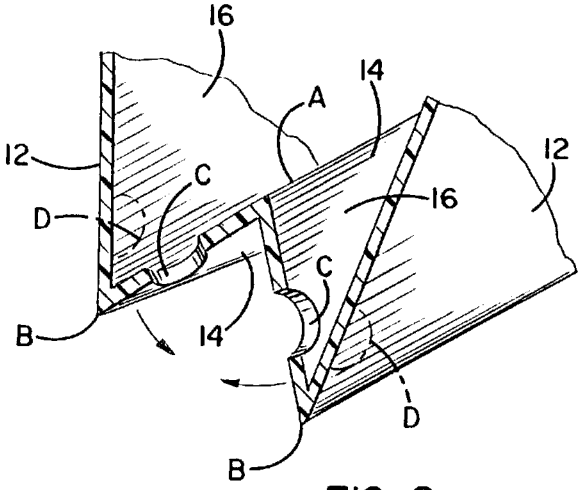
FIG. 8 is an enlarged fragmentary cross-sectional view taken substantially along the line 8—8 of FIG. 1.
Figure 9:
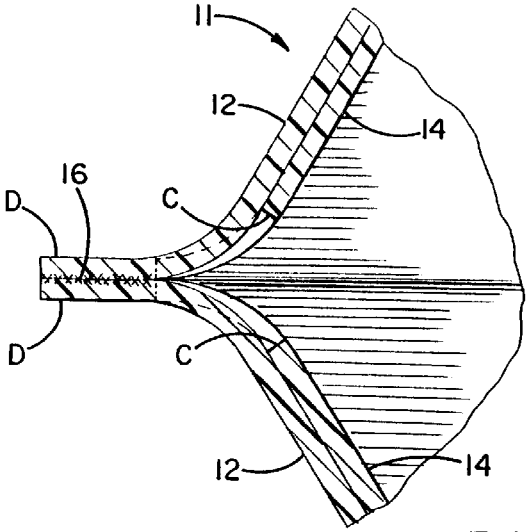
FIG. 9 is an enlarged fragmentary cross-sectional view taken substantially along the line 9—9 of FIG. 2.

In general, the pouch 11 is formed with two outer panels 12 and two smaller inner panels or gussets 14 which coact with the outer panels to define a folded pouch having a bottom portion of W-shaped cross-section (see FIG. 8). Specifically, the gussets are located between the bottom margins of the outer panels and are interconnected with one another by a common inner margin "A", the outer margins of the gussets being integrally connected with the bottom margins of the outer panels by common margins "B". During formation of the pouch, the side margins of the gussets and the side margins of the outer panels are joined and sealed together to close the sides of the pouch. When the pouch is filled, the gussets unfold downwardly to form a substantially flat bottom to enable the filled pouch to be free standing as the lower end portions of the outer panels expand outwardly (see FIG. 2). In addition and as further discussed below, the lower side margins of the two outer panels are connected together to prevent the lower side edges of the outer panels from expanding outwardly when the pouch is filled and to aid in supporting the free-standing pouch.

More specifically, the pouches 11 are formed from a flexible web 15 having one side which is heat sealable. The web is typically a laminate made with, for example, an outside layer of paper or polyester, a center layer of foil, and a second outside layer of a heat-sealable material 16. As further described below, the pouch is formed by folding the web so that the heat-sealable material is located on the inside surfaces of the pouch to enable the side margins of the pouch to be heat-sealed.

Figure 1:
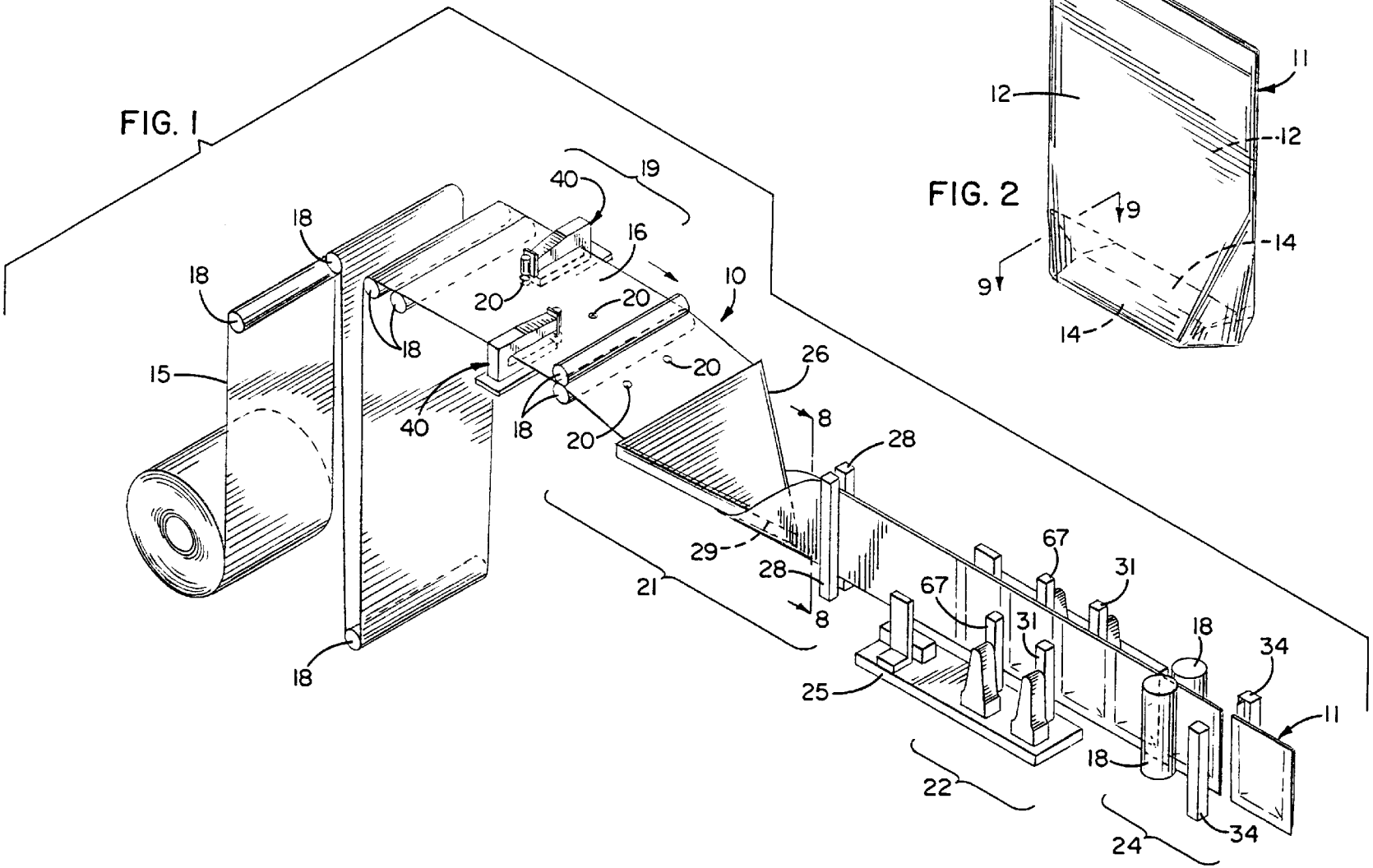
FIG. 1 is a schematic perspective representation of a machine for forming pouches from a continuous web of material and equipped with a new and improved punching station incorporating the unique features of the present invention.
Figure 3:
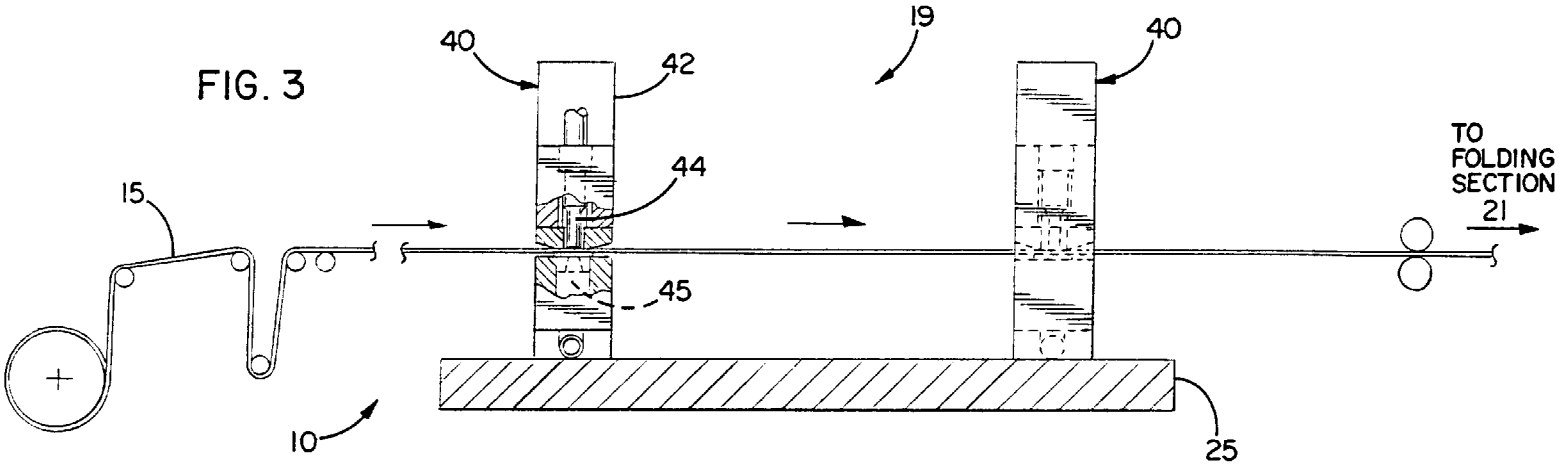
FIG. 3 is a fragmentary front view of the machine, including two punch assemblies of the punching station.

The web 15 is supplied to the machine 10 from a roll and is advanced step-by-step in the longitudinal direction, from left to right as shown in FIG. 1, through the machine by a pair of feed rolls (not shown). For reasons which will become apparent subsequently, the feed rolls preferably advance the web such that the pull-length of each step is equal in length to the width of a pouch 11. Various rollers 18 (FIG. 1) support and guide the web as it advances through the machine and insure that the web is properly tensioned.

The machine 10 also includes a punching station 19 adapted to punch pairs of openings 20 in the web 15, a folding station 21 adapted to fold the web into the W-shaped cross-section (see FIG. 8), a sealing station 22 adapted to form the folded web into a row of interconnected pouches, a cut-off station 24 which separates individual pouches 11 from the row of interconnected pouches, and a base 25 or other support means for mounting the components of the machine.

During normal operation of the machine 10, the two laterally spaced openings 20 are formed in the web 15 at the punching station during each pause or dwell period between the steps in the advancement of the web. Each pair of openings 20 consists of two preferably circular openings which are aligned with one another in the lateral direction relative to length of the web, i.e., relative to the direction of travel of the web. As a result, adjacent pairs of openings are longitudinally separated in the web by a distance equal to the pull length of the web, i.e., the pairs are separated by a distance which is approximately equal to the width of the pouch 11.

The folding station 21 includes a pair of vertical guides 28 and a folding plow 26 which includes a gusset-forming plow nose 29. In the embodiment shown, the advancing flat web 15 enters the folding plow in a substantially horizontal plane with the heat-sealable material 16 being located on the upper surface of the web. As the web passes through the folding plow, the longitudinal center portion of the web is raised so as to form what will become the common margin and center peak "A" between the folded gussets 14. As the web continues to advance through the folding station, the vertical guides cause the sides of the web to define the vertical outer panels 12. At the same time, the folds between the outer panels and the adjacent gussets are formed as the web advances past the plow nose. With this arrangement, the advancing web exits the folding station with its lower end portion having a continuous folded W-shape (see FIG. 8), with the heat-sealable surfaces on the gussets facing oppositely and outwardly relative to one another and with the heat-sealable surfaces on the outer panels facing inwardly toward one another.

The sealing station 22 includes a pair of aligned, vertically extending, heated sealing bars 31 which are located on opposite sides of the folded web 15, and further includes means (not shown) for cyclically advancing and retracting the sealing bars toward and away from one another. The sealing bars are operable to press against the folded web and to heat the web on the inside surfaces thereof along vertically extending portions of the web so as to form a vertically extending seal in the web. Each time the web pauses between steps, i.e., each time after the web advances by a distance equal to the pouch width, the sealing bars close to form a strip seal in the folded web. In this way, the seal bars are operable to form longitudinally spaced seals in the folded web so as to define the row of pouches 11 interconnected at the newly formed seals as the web advances step-by-step through the machine 10.

The cut-off station 24 includes a pair of aligned, vertically extending, cut-off blades 34 which are located on opposite sides of the folded web 15, and further includes means (not shown) for cyclically advancing and retracting one blade toward and away from the other blade. The cut-off blades are positioned relative to the seal bars 31 so that, after each step in the advancement of the web, the center of a seal is aligned with the cut-off blades. When the web dwells, one blade is moved toward the other in order to cut through the seal in the folded web. As a result, after each step in the advancement of the web, the cut-off blades remove the leading pouch 11 from the advancing row of interconnected pouches.

Figure 6:
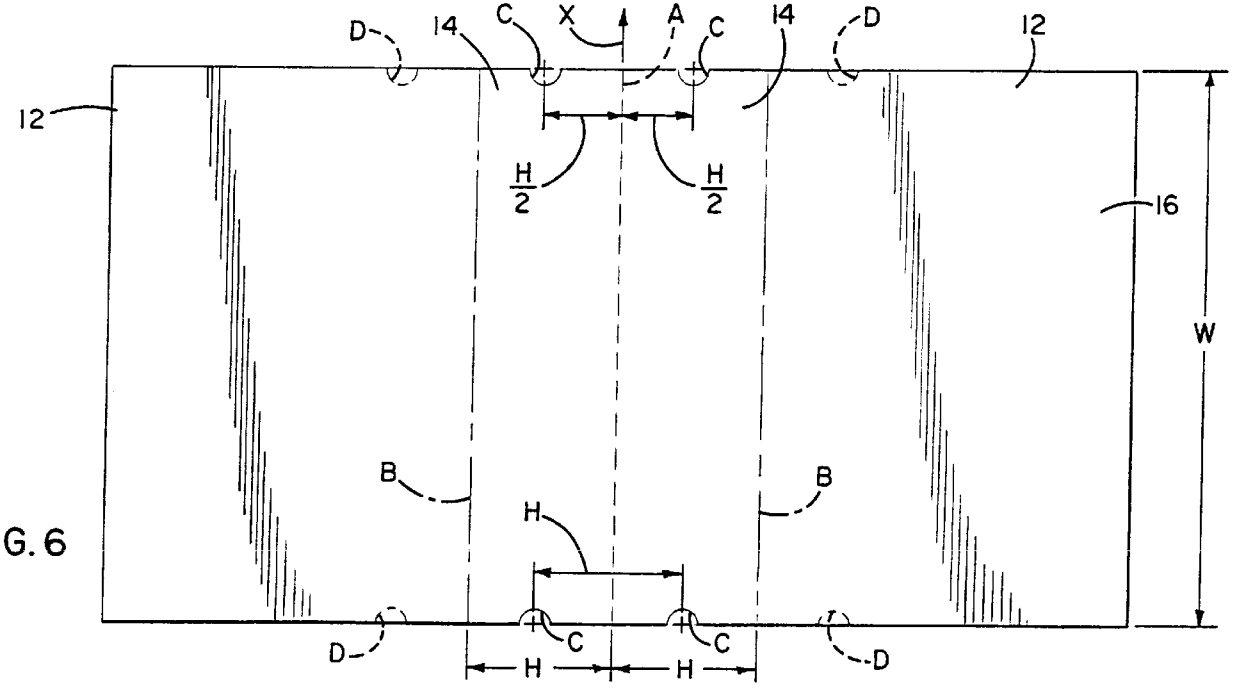
FIG. 6 is a top view of a portion of the web prior to the web being folded into a pouch.
Figure 7:
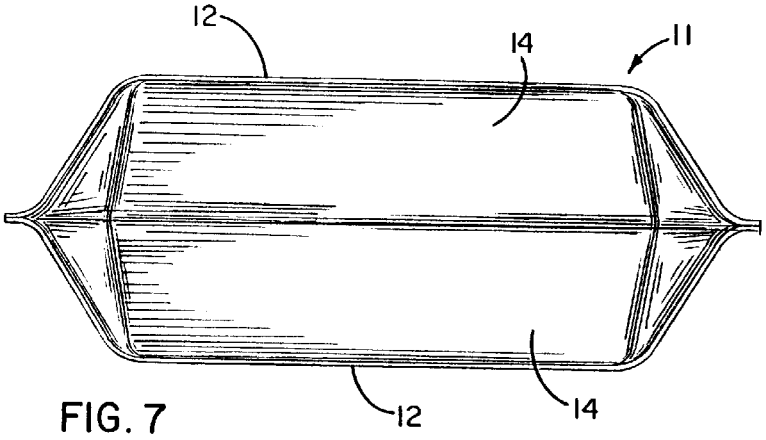
FIG. 7 is a bottom plan view of the filled pouch.

The configuration of the pouch 11 may be further understood by conceptually separating the sealed sides or edges of a pouch, unfolding the pouch, and laying the unfolded pouch flat. Specifically, a pouch is formed from a portion of the web 15 such as shown in FIG. 6. The direction of pull through the machine of such a portion is indicated by the arrow "X". The dimension "W" represents the width of the pouch, and therefore, a step in the advancement of the web caused by the pull-length of the feed rolls (not shown) of the machine. The dashed line "A" is coincident with the longitudinal center of the web and represents the common margin between the gussets 14. Each of the dashed lines "B" represents a common margin between an outer panel 12 and the adjacent gusset. Accordingly, each gusset is formed from the web between the dashed line "A" and one of the dashed lines "B", and the distance between the dashed line "A" and a dashed line "B" is equal to the gusset height "H". As the web passes through the folding station, the web is folded along lines "A" and "B" to generate the W-shaped cross-section shown in FIG. 8.

The semi-circular cut-outs "C" shown in FIG. 6 in the edge portions of the gussets 14 are the result of cutting through the center of the circular openings 20 when the cut-off blades 34 cut through the center of the seals to separate each leading pouch from the row of interconnected pouches. Accordingly, the cut-outs are spaced apart by a distance equal to the gusset height "H" and are equally spaced ("H/2") from the centerline "A".

When the web portion of FIG. 6 is folded along dashed lines "A" and "B", as shown in FIG. 8, the cut-outs "C" are laterally aligned with one another. The heat-sealable material 16 is located on the inwardly facing surfaces of the outer panels 12 and on the outwardly facing surfaces of the gussets 14. As a result, the heat-sealable surfaces on the gussets are in face-to-face relation with the heat-sealable surfaces on the lower portions of the outer panels, and the heat-sealable surfaces on the upper portions of the outer panels are in face-to-face relation.

When the side margins of the folded web portion of FIG. 6 are pressed together by the heated seal bars 31, the side margins of the gussets 14 bond with the lower side margins of the adjacent outer panels 12, and the upper side margins of the two outer panels bond with one another. Moreover, relatively small, substantially semi-circular regions "D" in the lower side margins of the outer panels are pressed into contact with one another by virtue of the openings in the edge portions of the gussets provided by the aligned cut-outs "C". Accordingly, the heat-sealable surfaces on the regions "D" bond the lower portions of the outer panels to one another, and the lower portions of the outer panels are precluded from separating or expanding outwardly when the pouch is filled. In this way, the lower side edges of the outer panels form side supports to aid in supporting the free-standing pouch.

Figure 4:
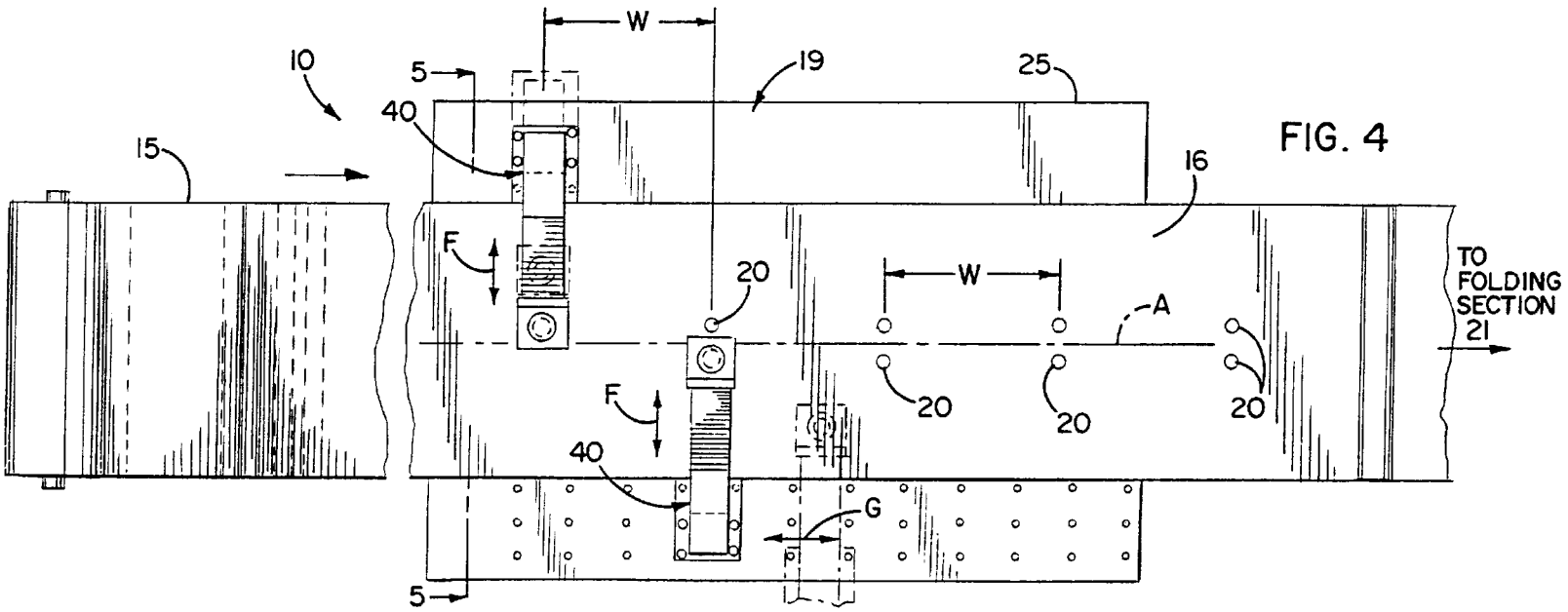
FIG. 4 is a fragmentary top view of the machine shown in FIG. 3 and shows alternate positions of the punch assemblies in phantom lines.

In accordance with the present invention, the punching station 19 includes two punch assemblies 40 which are adapted to form the openings 20 in the web 15 and which are independently and selectively positionable. Specifically, the lateral position of each punch assembly is adjustable as illustrated in FIG. 4 by phantom lines and in the direction of the arrows "F". In addition, the longitudinal position of at least one punch assembly is adjustable as indicated by phantom lines and in the direction of the arrow "G". The position of the punch assemblies is adjusted so that, during normal operation of the machine, the punch assemblies are longitudinally staggered and are longitudinally spaced from one another by a distance equal to the pull-length "W" of the web. As a result, adjustment of the lateral position of either punch assembly in the direction of the arrows "F" is generally unencumbered by the other punch assembly. Accordingly, the lateral position of the punch assemblies may be adjusted so that one punch assembly punches an opening which is laterally offset in one direction from the center "A" of the web 15 by a predetermined distance and the second punch assembly punches an opening which is laterally offset by a predetermined distance in the opposite direction. In the preferred embodiment, the punches are laterally separated from one another by a distance equal to the height "H" of the gusset and are equally spaced from the center of the web. As a result, the staggered punch assemblies can be adjusted to form pairs of openings 20 for pouches having gussets 14 of various heights. Also, the punch assemblies may be adjusted to form openings which lie on or are in very close proximity to the longitudinal centerline of the web.

In carrying out the invention, each punch assembly 40 is movably and adjustably mounted on the support 25 by a suitable adjusting means. For example, the mounting and adjusting means might utilize a simple lead screw arrangement with a hand crank for turning the lead screw to adjust the position of the punch assemblies. In this instance, dial indicators might be used for indicating the location of the punch assemblies, or the distances might be simply measured. Alternately, the mounting and adjusting means might include a sophisticated, completely motorized arrangement controlled by a feedback control system.

Figure 10:
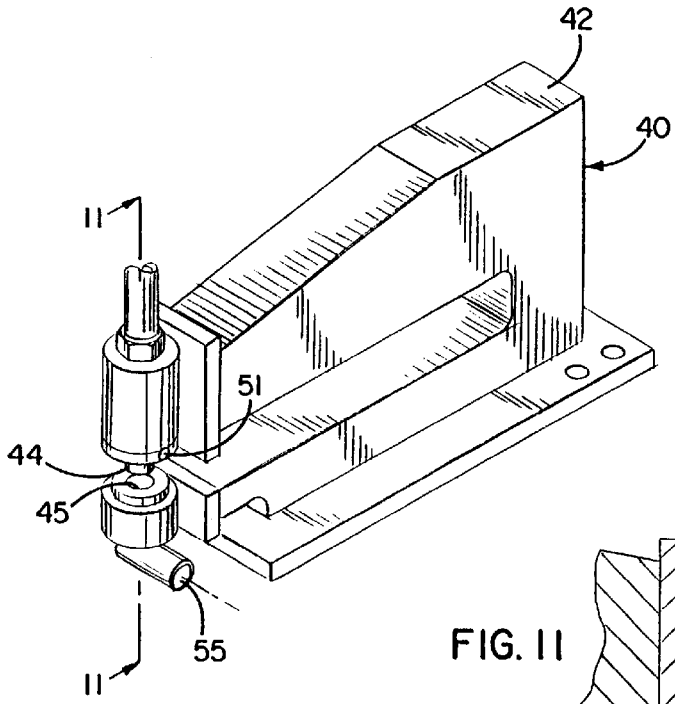
FIG. 10 is an enlarged perspective view of a punch assembly.
Figure 11:
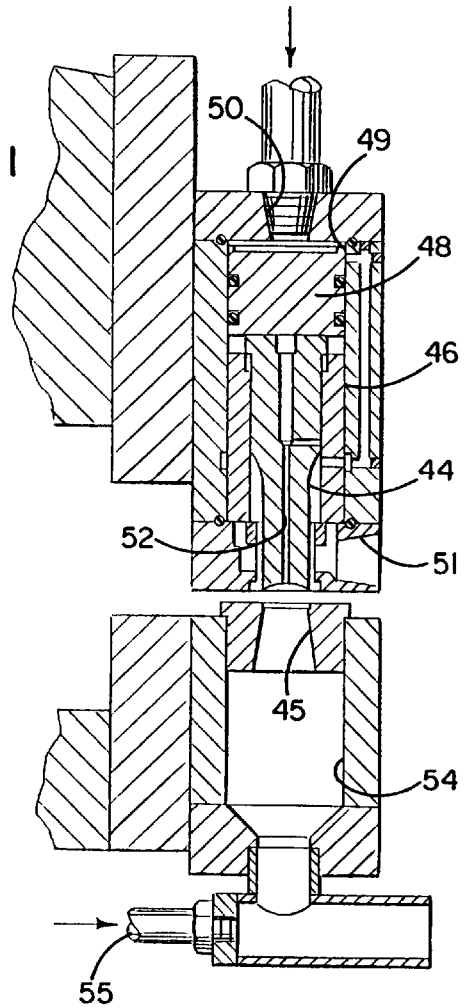
FIG. 11 is an enlarged cross-sectional view taken substantially along the line 11—11 of FIG. 10.

Each punch assembly 40 includes a frame 42 (FIG. 10), a punch 44 in an upper portion of the frame, and a die 45 in a lower portion of the frame and adapted to receive the punch. The punch and die are typically matched with a relatively small diametral clearance (e.g., 0.0005") to enable the punch to shear cleanly through the web 15. The frame is relatively stiff to allow the punch to enter the die in spite of such small clearance. In the embodiment illustrated, the punch is located above the web, and the die is located below the web so that the punch acts in a vertical direction. The punch is slidably mounted in a sleeve 46 located in the frame and is coupled to a piston 48. The piston is slidably located in a cylinder 49 and is actuated by a pressurized air supply. When air pressure is supplied to an upper port 50, the pressure drives the piston and the punch downwardly to cut through the web. When air pressure is reduced at the upper port and then supplied to a lower port 51, the piston and the punch are driven upwardly.

Figure 12:
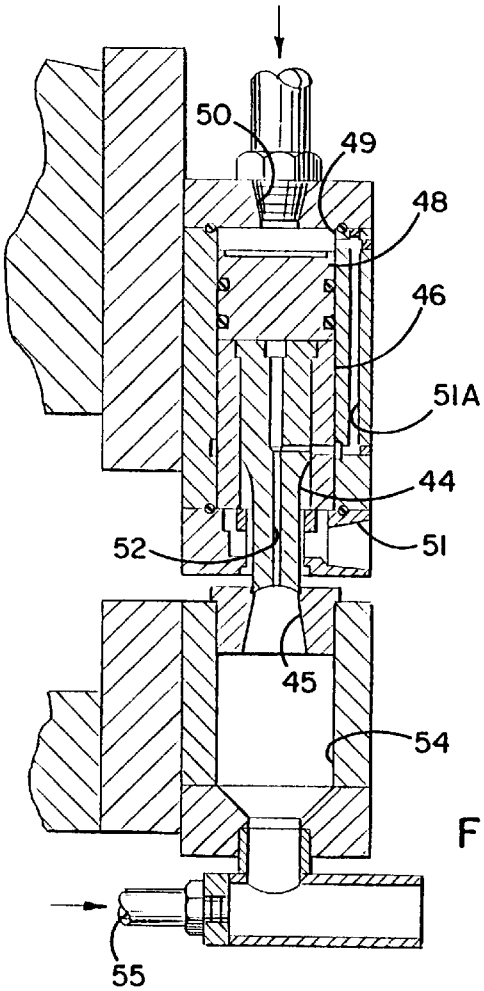
FIG. 12 is a view similar to FIG. 11 but shows certain parts in an actuated position.

Advantageously, the punch assembly 40 includes an internal passageway 51 which, while the piston 48 is in the down position (FIG. 12), supplies air pressure from the actuating cylinder 49 to a passageway 52 formed through the center of the punch 46 to "blow" the slug of sheared web material downwardly into a receptacle 54. The accumulated slugs are then carried away from the receptacle by an additional air supply 55.

In the preferred embodiment, the frame 42 is a C-shaped frame and the punch 44 and die 45 are carried at the open end of the C-frame. The C-frame is formed with upper and lower legs which are connected together by a back support member. The throat depth of the C-frame as defined by the length of the legs is preferably sized so that the punch 44 may extend inwardly to at least the longitudinal centerline of the web 15. In the embodiment shown, the two C-frames are positioned so as to reach inwardly toward the center of the web from opposite sides of the web.

When the machine 10 is set up to form pouches 11 of a predetermined width "W" and having a predetermined gusset height "H", the feed rolls, as previously mentioned, are rotated such that the pull-length of the web is equal the desired width of the pouch. The absolute and relative spacing between the seal bars 31 and the cut-off blades 34 is also set for the desired pouch width. The punch assemblies 40 are then adjusted so that the longitudinal spacing between the two punches 44 is equal to the desired pouch width. The lateral spacing or center distance between the two punches is adjusted to be equal the desired height of the gusset while maintaining the punches equally spaced from the centerline of the web.

With this arrangement, the punch assemblies 40 are uniquely operable to punch longitudinally spaced pairs of laterally spaced openings 20 in the web 15 as the web advances through the machine 10. The first punch assembly punches a first opening in the web during a pause in the advancement of the web. When the web advances one step, the first opening advances by a distance equal to the pull-length of the web and is therefore laterally aligned with the second punch assembly. During the next dwell period, the second punch assembly punches a second opening which is laterally aligned with the first opening and which, together with the first opening, defines a pair of openings. At the same time, the first punch assembly punches another opening which defines the first opening of the next pair of openings. As a result, as the web advances step-by-step through the punching station 19, the second punch assembly forms an opening which is aligned with an opening that was previously formed by the first punch assembly during the preceding dwell period, and the pairs of openings are spaced longitudinally from one another by a distance equal to the width of the pouches.

In the event that a pouch 11 having a different width is then to be formed on the machine 10, the longitudinal spacing of the punch assemblies 40 is simply adjusted so as to be the same as the new pouch width. In the event that a pouch having a different gusset height is to be formed on the machine, the lateral spacing of the punch assemblies simply needs to be adjusted so that the spacing between the punches 44 is equal to the new gusset height "H". If both the pouch width and the gusset height are to change, both the lateral and the longitudinal positions of the punch assemblies will need to be adjusted.

Figure 5:
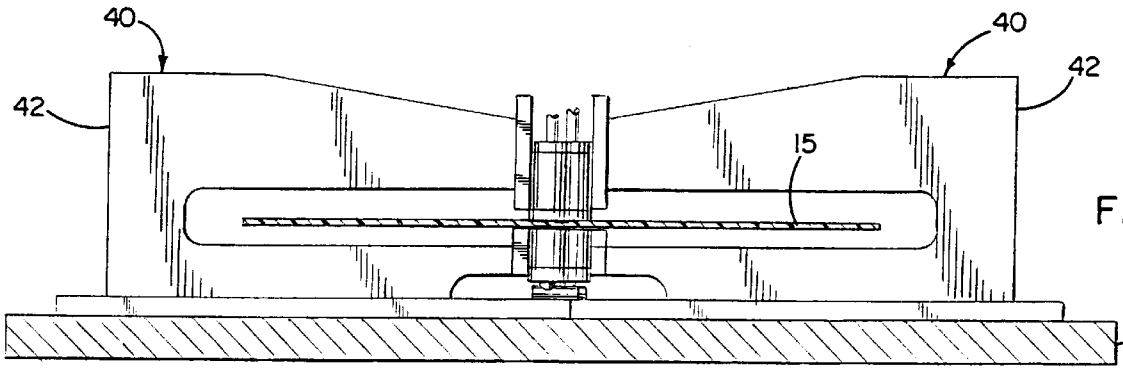
FIG. 5 is an enlarged cross-section taken substantially along the line 5—5 of FIG. 4.

Advantageously, the staggered location of the punch assemblies 40 enables the punches 44 to punch openings 20 which are relatively close to one another in the lateral direction. Specifically, and as illustrated in FIGS. 4 and 5, each punch frame 42 may extend beyond the centerline of the web without interfering with the placement and location of the other punch frame. This enables the punches to be positioned on or relatively close to the center of the web 15. With this unique arrangement, the punches could overlap the center of the web so that the punches would coact to form one elongated opening in the web for pouches having very small gussets. Alternately, when the lateral spacing between the openings is relatively large, the punch assemblies could be simply aligned with one another to form the pairs of openings.

Figure 13:
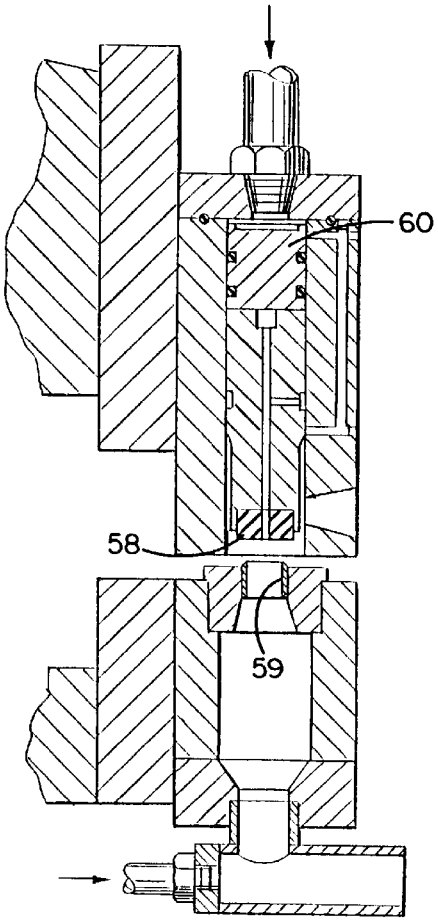
FIG. 13 also is a view similar to FIG. 11 but shows an alternate punch assembly.

Further in accordance with the invention, the punch 44 and the die 45 may be replaced by a relatively hard, rubber die pad 58 (FIG. 13) and a die cutter 59, respectively. In this instance, the die cutter is formed with a relatively sharp edge to cut through the web 15 when the die pad, which is connected to the piston 60, is actuated by air pressure. Advantageously, the die pad and die cutter are relatively quiet during the operation of the machine, are relatively low cost, and eliminate the need to maintain the close clearances and tolerances of the standard-type punch and die set.

Figure 15:
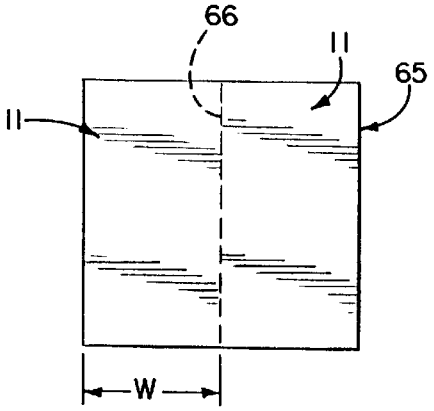
FIG. 15 is a side elevational view of a typical tandem pouch.
Figure 14:
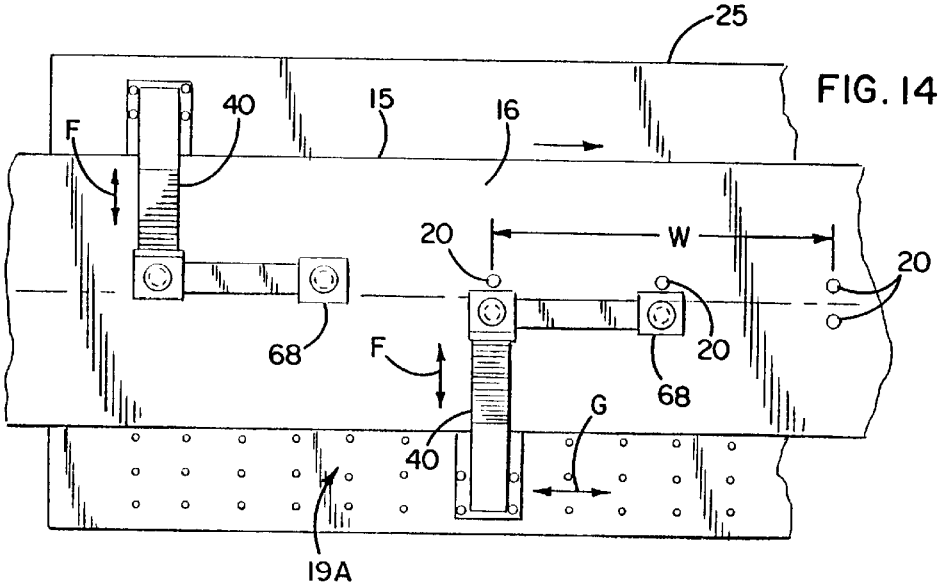
FIG. 14 is a top view similar to FIG. 4 but shows alternate punch assemblies adapted for forming tandem pouches.

In an alternate embodiment, the machine 10 (FIG. 14) is adapted to form so-called tandem pouches 65 (FIG. 15). A tandem pouch consists of two interconnected pouches 11 with a perforated tear-strip 66 formed between the pouches to enable separation of the pouches by hand. In this instance, the machine includes a second set of seal bars 67 (FIG. 1) which are separated from the first set by a distance equal to the pouch width "W". The machine also includes a station (not shown) for forming the perforation in the seal separating the tandem pouches, the perforation being formed during the dwell period between each advancement of the web. Alternately, the perforation may be formed by the second set of seal bars if the same are appropriately modified. In addition, the feed rolls are adjusted for a pull-length equal to two times the width of each pouch. As a result, the cut-off blades 34 separate the two leading pouches from the row of interconnected pouches, the perforated strip being located between the two pouches.

In carrying out the invention, a second tandem punch and die assembly 68 is secured to each of the punch assemblies 40 for lateral movement with the punch assemblies and for longitudinal movement relative to the punch assemblies 40. The longitudinal position of each tandem punch is adjusted so as to be longitudinally spaced from the corresponding punch assembly 40 by a distance equal to the selected pouch width. As a result, two pairs of openings 20 are formed during the dwell period between each step in the advancement of the web.

From the foregoing, it will be apparent that the present invention brings to the art a new and improved method and machine 10 for punching pairs of closely spaced openings 20 in a sheet 15 of advancing material. The use of adjustable and staggered punch assemblies 40 for punching such pairs of openings enables relatively quick and easy adjustment of the spacing between the openings of each pair to enable the machine to form side-supported pouches having gussets of various heights. Such adjustability substantially reduces the capital costs associated with forming side-supported gusset pouches as compared with prior machines of the same general type. Specifically, the staggered punching arrangement eliminates the need to purchase multiple matched punch and die sets, and the attached peripheral equipment, in order to change the spacing between the openings so as to form pouches having different gusset heights.

I claim:

1. An apparatus for forming a pouch with a gusseted bottom from a continuous web as the web is longitudinally advanced in step-by-step fashion by incremental distances substantially equal to a pouch width, the pouch having opposed pairs of first and second openings through gusset members formed near a web centerline so that after folding along the centerline the openings allow side walls to be joined through the gusset members, the apparatus including a punching mechanism for forming the opposed pairs of first and second openings, the punching mechanism comprising:

a support;

first and second punch means mounted on said support and longitudinally separated from one another by a distance substantially equal to the pouch width, the first and second punch means being operable to punch the first and second openings respectively as the web is incrementally advanced;

the respective punch means being laterally spaced from the web centerline in opposite directions at substantially equal distances and adjustable laterally with respect to the centerline so that a first opening formed by the first punch is positioned to register with a second opening formed by the second punch when the gusseted pouch is folded; and means for longitudinally advancing the web.

2. The apparatus as defined in claim 1 further comprising first and second frames carrying said first and second punch means, respectively, each of the frames having first and second members connected to one another, the members of each frame having free end portions located on opposite sides of the web and extending laterally inwardly from the edges of the web such that a portion of the web is disposed between the members, the punch means of the frame being connected to the free end portions of the members.

3. The apparatus as defined in claim 1 in which the punch means include a pad formed from die-rubber and a cutter formed with a cutting edge portion, the pad being adapted to engage the cutter when the web is interposed between the pad and the cutter so as to cause the cutter to cut through the web.

4. A method of punching longitudinally spaced pairs of first and second laterally aligned openings in a gusseted pouch, the openings being punched near a web centerline so that after folding along the web centerline the openings allow side walls to be joined through a gusset, the method comprising the steps of:

a. providing first punch means laterally spaced from the web centerline in one direction and a second punch means laterally spaced from the web centerline in an opposite direction, the first and second punch means being spaced substantially equal distances from the web centerline and longitudinally separated from one another by a distance substantially equal to a pouch width, the first and second punch means being operable to punch the first and second openings, respectively;

b. providing means for longitudinally advancing the web in step-by-step fashion by incremental distances substantially equal to the pouch width;

c. punching the first opening of a first pair of laterally aligned openings with the first punch means when the web dwells;

d. incrementally advancing the web;

e. punching the first opening of a second pair of laterally aligned openings with the first punch means and the second opening of the first pair of laterally aligned openings with the second punch means when the web dwells; and f. repeating steps d and e;

wherein the first and second punch means are positioned so that the first opening of each pair of openings formed by the first punch means substantially registers with the second opening of each pair of openings formed by the second punch when the gusseted pouch is folded along the web centerline.

5. A method of making a pouch of predetermined width and having a bottom formed with gussets of predetermined height, said method comprising the steps of:

providing a flexible web having heat-sealable material on one side thereof;

advancing the web longitudinally and intermittently through steps equal in length to the width of the pouch;

punching a first opening through the web on one side of the longitudinal centerline thereof when the web dwells between successive steps;

punching a second opening through the web on the opposite side of the centerline thereof and in lateral alignment with the first opening when the web subsequently dwells after punching of the first opening, each opening being spaced laterally from the centerline of the web by a distance equal to one-half the height of the gussets;

folding a portion of the web into a W-shape, the W-shaped portion having (a) two longitudinally extending and adjacent inner gussets connected by a common inner margin, and (b) two outer panels adjacent to the gussets and extending from the gussets, the heat-sealable material on the gussets being in face-to-face relation with the heat-sealable material on adjacent portions of the outer panels, the heat-sealable material on the remaining portions of the outer panels being in face-to-face relation, and the first and second openings being aligned with one another;

heating the web along a strip extending laterally through the first and second openings such that the heat-sealable material on the outer panels bonds together through the aligned openings, and cutting through the strip so as to separate the pouch from the folded portion of the web.

* * * * *